US005211656A

United States Patent [19]

Maddocks et al.

[11] Patent Number: 5,211,656

[45] Date of Patent: May 18, 1993

[54] PACIFIER

[76] Inventors: Richard J. Maddocks, 302 Lexington Dr., Silver Spring, Md. 20901; Richard C. Levy, P.O. Box 34828, Bethesda, Md. 20827

[21] Appl. No.: 810,853

[22] Filed: Dec. 20, 1991

[51] Int. Cl.[5] ..... A61J 17/00

[52] U.S. Cl. ..... 606/236; 606/234; 606/235

[58] Field of Search ..... 215/11.1-11.6; 606/234, 235, 236

[56] References Cited

U.S. PATENT DOCUMENTS

| | | | |
|---|---|---|---|
| 2,860,639 | 11/1958 | Hoover | 606/234 |
| 3,363,630 | 1/1968 | Mines | 606/234 |
| 3,601,129 | 8/1971 | Seidl | 606/236 |
| 4,417,613 | 11/1983 | Ryan et al. | 606/234 |
| 4,493,324 | 1/1985 | Johnston . | |
| 4,819,641 | 4/1989 | Russell et al. . | |
| 4,852,569 | 8/1989 | Sanders | 606/234 |
| 4,909,253 | 3/1990 | Look et al. | 606/234 |
| 4,946,054 | 8/1990 | Maniero et al. | 215/11.6 |

FOREIGN PATENT DOCUMENTS

| | | | |
|---|---|---|---|
| 0019385 | 9/1934 | Australia | 606/234 |
| 875259 | 3/1953 | Fed. Rep. of Germany . | |
| 1287253 | 1/1969 | Fed. Rep. of Germany . | |
| 1499738 | 10/1967 | France . | |
| 261502 | 4/1949 | Switzerland . | |
| 0549227 | 11/1942 | United Kingdom | 606/234 |
| 2192341 | 1/1988 | United Kingdom . | |

*Primary Examiner*—Stephen C. Pellegrino
*Assistant Examiner*—Glenn Dawson

[57] ABSTRACT

A pacifier includes a shield having nipples projecting in opposite directions from its opposite sides. A cover is provided for releasable securement to alternate sides of the shield covering and protecting one of the nipples, while enabling the opposite nipple to be exposed for use. Upon contamination of the exposed nipple, the cover can be removed from the clean nipple and replaced on the opposite side of the shield covering the contaminated nipple and exposing the clean nipple for use.

2 Claims, 1 Drawing Sheet

PACIFIER

BACKGROUND AND SUMMARY OF THE INVENTION

The present invention relates to pacifiers for use with infants and small children and particularly to a novel and improved hygienic pacifier having a cover for protecting the nipple of the pacifier having one or more nipples.

Many different types of pacifiers have been proposed and constructed in the past. Typically, such pacifiers include a shield which may be either flat or contoured to present a flat or concave surface, respectively, to the mouth of the infant or small child. (For purposes of the application, the user of the pacifier of this invention, whether an infant, small child or otherwise, will be referred to from time to time as an "individual") A nipple, of course, projects from one side of the shield for insertion into the individual's mouth. Conventionally, the opposite side of the shield is provided with a handle, such as a ring, to facilitate insertion and withdrawal of the pacifier, respectively, into and from the individual's mouth. While these pacifiers have proven satisfactory, not infrequently the infant or small child will drop the pacifier and invariably the nipple of the pacifier becomes soiled. The nipple must therefore be cleaned before being placed back into the individual's mouth and oftentimes there is nothing convenient with which to clean the nipple. Further, a replacement pacifier is not always available, particularly when the individual is away from home. Also, for those pacifiers which provide a cover for the nipple, the cover is often misplaced when removed from the nipple in order to use the pacifier. When removed, the cover may also become contaminated. Thus, even where the individual does not drop the pacifier and is only temporarily through using it, frequently the cover is not readily available or cannot be located so that the nipple may be once again covered and protected against contamination for later use. Further, if the cover is contaminated when removed, it makes little sense to re-cover the nipple with a contaminated non-hygienic cover. Moreover, most pacifier covers are applied to the shield with a snap-fit. With this type of connection, inadvertent release of the cover from the pacifier shield sometimes occurs, rendering the cover essentially useless and exposing the nipple to contamination.

To overcome these and other shortcomings of prior pacifiers, the present invention provides a novel and improved pacifier having various improved features. For example, to avoid cleaning the nipple of the pacifier when contaminated and to facilitate quick reuse of the pacifier, the present invention provides, in one embodiment hereof, a pacifier having a pair of nipples which project on opposite sides of a shield. A single cover is supplied with the pacifier and is adapted for releasable securement to either side of the shield whereby one or the other of the nipples can be covered and protected against contamination. The pacifier of the present invention thus provides, in effect, a spare clean nipple which can be used should the uncovered nipple in use become contaminated, for example, by dropping the pacifier, as previously noted. Consequently, by removing the cover from the second clean nipple, the clean nipple may be inserted into the individual's mouth, with the shield separating the contaminated nipple from the clean nipple. The contaminated nipple, of course, projects outwardly from the shield, outside of the individual's mouth.

It is a further feature of the present invention that the cover may be releasably secured to either side of the shield. Thus, not only are the nipple or nipples protected against contamination, but the cover itself is protected against contamination by storing it on the non-in-use side of the pacifier. For example, when the first nipple is in use, the cover overlies the second clean nipple on the opposite side of the shield, protecting the second nipple and itself against contamination. Should it be necessary to expose the second clean nipple for use, e.g., in the event the first nipple becomes contaminated, the cover is first removed from the clean nipple and applied over the contaminated nipple on the opposite side of the shield. The cover may also be optionally provided with a handle so that it may be readily removably secured to either side of the shield, as desired.

As evident, it is important that a secure, yet releasable attachment be provided between the cover and shield. To accomplish this, the shield may be provided with two or more apertures opening through opposite sides of the shield. The cover may have a corresponding number of projections receivable within the respective apertures. The apertures and projections have cooperating detents such that, upon insertion of the projections into the apertures and rotation of the cover and shield relative to one another, the detents engage and lock the cover to the shield to one another. Also, the projections have tips which engage behind complementary flanges in the apertures of the shield to prevent axial removal of the cover. The projections and apertures are configured to enable insertion of the projections into the apertures from either side of the shield and hence enable ready releasable securement of the cover to either side of the shield.

Still further, the nipples are preferably formed of a flexible material. Thus, the depth of the cover may be less than the length of the nipple whereby the cover compresses the covered nipple. An important feature of the present invention also resides in the alignment of the apertures of the shield with apertures in the cover whereby, when the cover is secured to either side of the shield, at least one or more vent openings are provided through the cover and shield.

In a preferred embodiment according to the present invention, there is provided a pacifier comprising a shield, a pair of nipples projecting from opposite sides of the shield in generally opposite directions and a cover for alternately overlying the nipples on opposite sides of the shield. Means are cooperable between the cover and the shield for securing the cover and the shield one to the other in alternate positions on either side of the shield whereby each of the nipples may be covered by the cover while the other nipple is exposed for use.

In a further preferred embodiment according to the present invention, there is provided a pacifier comprising a shield, at lest one nipple projecting from one side of the shield and a cover for overlying the nipple on the one side of the shield. Means are provided cooperable between the cover and the shield for securing the cover to the shield in alternate positions on either side of the shield whereby the one nipple on one side of the shield may be covered by the cover and the cover removed for securement to the opposite side of the shield, thereby exposing the one nipple for use, the cooperable means including means responsive to relative rotation of the cover and the shield for releasably securing the cover and shield one to the other on each of the opposite sides of the shield.

Accordingly, it is a primary object of the present invention to provide a novel and improved pacifier having a cover for a nipple which may be secured on either side of the pacifier shield and, where two nipples are provided, the cover overlies the first nipple to maintain it clean, while the other nipple is exposed for use.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
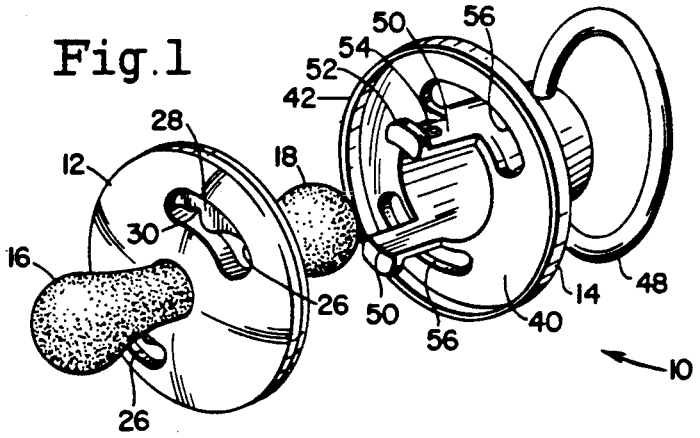
FIG. 1 is an exploded perspective view of a pacifier constructed in accordance with the present invention.
Figure 3:
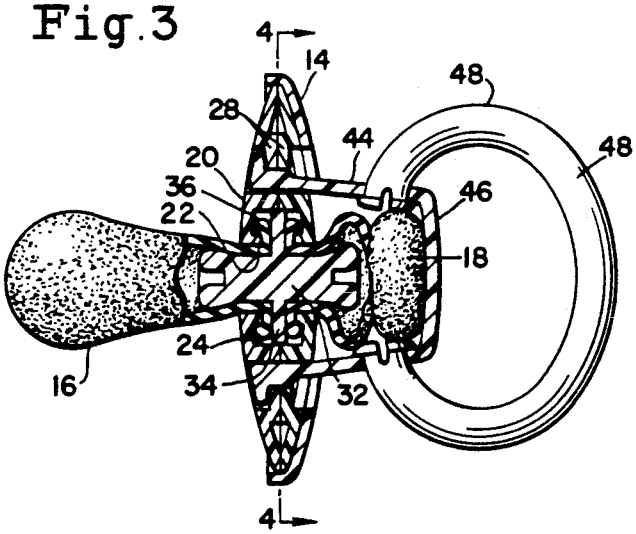
FIG. 3 is a fragmentary cross-sectional view of the pacifier hereof, with the cover on one side covering a nipple and the nipple on the other side exposed for use.
Figure 4:
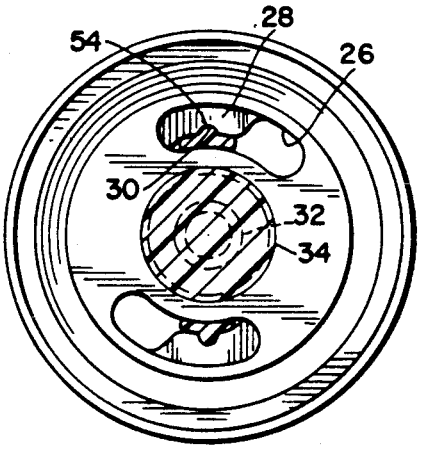
FIG. 4 is a cross-sectional view thereof taken generally about on line 4—4 in FIG. 3.

Referring now to the drawings, particularly to FIG. 1, there is illustrated a pacifier constructed in accordance with the present invention and generally designated 10. Pacifier 10 includes a shield 12, cover 14 and a pair of nipples 16 and 18 projecting from opposite sides of shield 12. Referring to FIGS. 1 and 3, shield 12 includes a pair of generally disk-like elements 20 formed of a suitable plastic material, for example, A.B.S. plastic and disposed in back-to-back relation one with the other. Disks 20 are provided with a central opening 22 (FIG. 3). Additionally, recessed annular grooves 24 are provided in the central opening 22 for receiving marginal portions of the nipples, as described below. Each disk 20 includes preferably at least a pair of diametrically opposed, circumferentially extending slots or apertures 26, although additional apertures 26 may be provided. Along the back side of each of the disks 20 and projecting radially inwardly for only a portion of the circumferential extent of each aperture 26 is a radially inwardly directed flange 28. Flange 28 includes a radially outwardly directed groove or recess 30. As illustrated in FIG. 3, when disks 20 are disposed in back-to-back relation, the flanges 28 register one with the other, forming a centrally located, radially inwardly directed composite flange for purposes described hereinafter.

Figure 2:
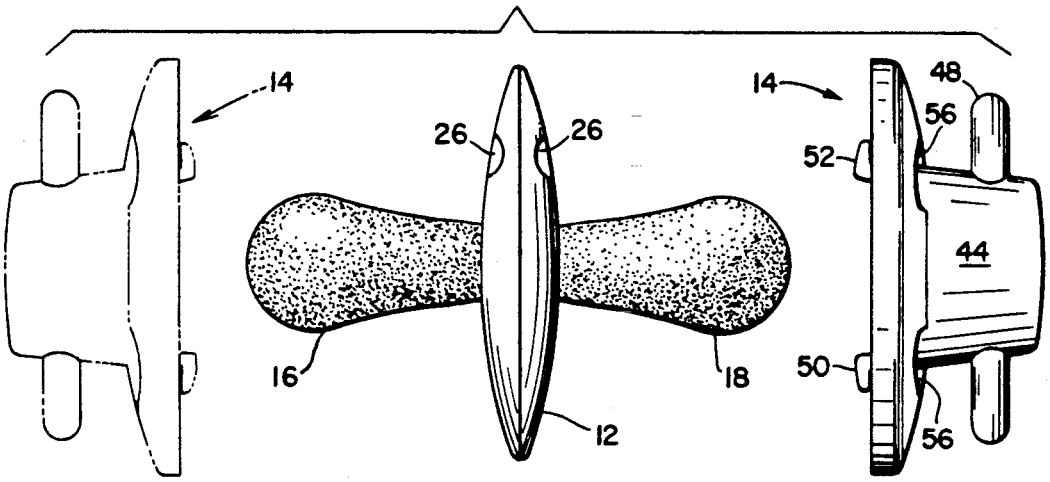
FIG. 2 is a side elevational view of a pacifier according to the present invention illustrating the cover on opposite sides of the shield.

Again referring to FIG. 3, it will be appreciated that each of the nipples 16 and 18 are formed of silicone or latex rubber and are thus flexible, compressible and reformable to the shape generally illustrated in FIGS. 1 and 2. A preferred manner of securing the nipples such that they project in opposite directions on opposite sides of shield 12 includes a central hub 32 having a central radially outwardly directed flange 34 for reception in recesses 24 of the central aperture 22 of shield 12. Hub 32 has enlarged distal ends which receive the open inner ends of the nipples, respectively. The distal ends of the nipples have enlarged beaded margins 36 for reception in the recesses 24.

To assemble the shield and nipples, the open ends of the nipples are first disposed about the opposite ends of the hub 32 with the beaded margins 36 aligned along opposite sides of the flange 34 of hub 32. The disks 20 may then be received over the respective distal ends of the nipples and the disks secured in back-to-back relation one to the other by a suitable adhesive, a heat-sealing process or ultrasonic welding. Thus, each of the nipples is secured to from the shield.

Referring now to FIG. 1, cover 14 includes a generally annular member 40 having an outer rim 42 for receiving the peripheral margin of shield 12 when the cover is applied to one or the other side of shield 12. Integrally formed with cover 14 is a generally cylindrical, frustoconical, projection 44 which opens at one end through the annular member 40 and is closed at its opposite end, for example, as illustrated at 46. A handle 48 in the form of a ring, while not a necessary part of the pacifier of this invention, may be optionally provided. Handle 48 may be suitably secured to the projection 44 for facilitating rotational and axial movement of cover 14 relative to shield 12. As illustrated in FIG. 3, the depth of projection 44 is less than the axial extent of each of the nipples 16 and 18. Consequently, when the cover 14 is applied to shield 12 in the manner described below, the nipple within cylindrical projection 44 flexes and compresses against the cap 46 of projection 44.

Referring to FIG. 1, at least a pair of projections 50 extend from the generally concave member 40 in a direction opposite projection 44 for reception in apertures 26 of shield 12. It will be appreciated that more than two projections 50 and apertures 26 may be provided about member 40 and shield 12 for cooperation with one another in the manner to be described. Projections 50 have radially outwardly directed tips 52. Also, a radially outwardly directed rib 54 extends along the outer surface of projections 50. Adjacent each intersection of projections 50 and member 40, there is provided a circumferentially extending aperture 56.

To releasably secure cover 14 and shield 12 one to the other, the projections 50 are aligned with the apertures 26. The space between each radially inwardly directed flange 28 and the end of aperture 26 is sufficient to receive the tips 52 of projections 50. After insertion of the tips of projections 50 into these spaces in apertures 26, the cover and shield are thereafter relatively rotated to locate the tips 52 behind the composite of flanges 28 on the side of the shield opposite projection 44 and to locate the ribs 54 in the recesses 30 of flanges 28 whereby the cover and shield are releasably detented into a secured position relative to one another. It will be appreciated that projections 50 of cover 14 can be disposed in the slots 26 from either side of shield 12 whereby the cover can be releasably secured to the shield alternately to either side. Additionally, it will be further appreciated that, when the cover is secured to the shield, the apertures 26 register and are in axial alignment with the apertures 56. These registering apertures serve as communicating vent holes between the side of the shield having the exposed nipple and the side of the shield mounting the cover nipple.

Consequently, it will be appreciated that with the foregoing construction, the pacifier may be provided with the cover secured to the shield, encapsulating one of the nipples, for example, the nipple 18 as illustrated in FIGS. 1 and 3. Thus, the cover maintains nipple 18 in a clean condition. Also, by storing the cover on the side of the pacifier not-in-use, the cover is protected against contamination which might otherwise occur if detached from the pacifier. With the cover overlying nipple 18, the nipple 16 may be inserted into the individual's mouth and the pacifier will function in a normal manner. Should the individual, however, drop the pacifier or the nipple 16 become otherwise contaminated, the cover may be removed to uncover the clean nipple for use. For example, by rotating cover 14 relative to shield 12, the ribs 54 may be snapped past detents 30 and into the portion of aperture 26 where tips 52 will clear the slot. Thus, by first rotating the cover to clear the tips from the flanges and then axially withdrawing the cover from the shield, the cover is removed and the compressed nipple 18 is exposed for use. It will be appreciated that the compressed nipple will return to its normal configuration and shape upon removal of cover 14 from shield 12.

The cover may then be applied to the opposite side of the shield 12. To accomplish this, the projections 50 are aligned with the clear portions of apertures 26 and the projections inserted such that the tips 52 lie on the opposite sides of the apertures. Rotation of the cover relative to the shield then engages the tips 52 behind the composite flanges 28 and the ribs 54 are detented in recesses 30. Thus, the clean nipple is exposed for use and the contaminated nipple is covered.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pacifier comprising a shield; a pair of nipples projecting from opposite sides of said shield in generally opposite directions; a cover for alternately overlying said nipples on opposite sides of said shield; and means cooperable between said cove rand said shield for securing said cover to said shield in alternate positions on either side of said shield whereby each of said nipples may be covered while the other nipple is exposed for use; wherein said shield has means defining a pair of apertures opening therethrough, said cover having a pair of projections for projecting into said apertures, respectively, and cooperable with said aperture defining means for releasably securing said cover to said shield; wherein said pair of projections and said aperture defining means include cooperating detents for releasably securing said cover to said shield in response to relative rotation of said cover to said shield.

2. A pacifier according to claim 1 including at least one vent hold through said cover, at least one of said apertures in said shield comprising a vent hole in communication with the vent hole through said cover.

* * * * *